US005953559A

United States Patent [19]

Obu

[11] Patent Number: 5,953,559

[45] Date of Patent: Sep. 14, 1999

[54] DEVICE AND METHOD FOR FORMING FULL-COLOR IMAGES

[75] Inventor: Makoto Obu, Kanagawa, Japan

[73] Assignee: Ricoh Company, Ltd., Tokyo, Japan

[21] Appl. No.: 09/144,352

[22] Filed: Aug. 31, 1998

[30] Foreign Application Priority Data

Sep. 5, 1997 [JP] Japan ..... 9-256229

[51] Int. Cl.[6] ..... G03G 21/16

[52] U.S. Cl. ..... 399/110; 399/111; 399/126; 399/233; 399/302

[58] Field of Search ..... 399/101, 111, 399/114, 126, 223, 233, 237, 238, 297, 299, 302

[56] References Cited

U.S. PATENT DOCUMENTS 5,652,080 7/1997 Yoshino et al. ..... 399/240

5,666,616 9/1997 Yoshino et al. ..... 399/240

FOREIGN PATENT DOCUMENTS 4221663 8/1992 Japan .

4-246573 9/1992 Japan .

*Primary Examiner*—William Royer

*Assistant Examiner*—William A. Noē

*Attorney, Agent, or Firm*—Oblon, Spivak, McClelland, Maier & Neustadt, P.C.

[57] ABSTRACT

A device including a plurality of image-formation units stacked one over another, and a photosensitive body, provided in each of the image-formation units, which has an electrostatic image formed thereon. Also included is a development unit, provided in each of the image-formation units, which develops the electrostatic latent image with a liquid development agent to create a development-agent image on the photosensitive body. In addition, a sheet-conveyer/transfer unit is included which transfers the development-agent image formed by the image-formation units onto a sheet conveyed by the sheet-conveyed transfer unit.

9 Claims, 5 Drawing Sheets

DEVICE AND METHOD FOR FORMING FULL-COLOR IMAGES

BACKGROUND OF THE INVENTION

1. Field of the Invention

The present invention generally relates to copier machines, printers, facsimile devices, or the like which have a plurality of image-formation units vertically positioned, and particularly relates to prevention of dirt made by a development agent inside the device or in a periphery thereof.

2. Description of the Related Art

For the purpose of enhancing image-formation speed, an image-formation device creating full-color images, such as a full-color copier machine, are provided with a plurality of image-formation units, and an example of such a configuration can be found, for example, in Japanese Laid-open Patent Application No.4-221663 and Japanese Laid-open Patent Application No.4-246573.

An image-formation device disclosed in these documents includes a base-body unit having a control device and a detachable sheet-supply tray, and further includes a plurality of image-formation units stacked one over another on the base-body unit. Each of the image-formation units has a case, and contains within the case an image-formation element equipped with alignment/mount parts provided at an upper end and a lower end thereof. The image-formation element is movable inside the case. Each of the image-formation units transfers a toner image from a photosensitive body thereof onto a sheet, and each toner image corresponds to a respective color, i.e., cyan, magenta, yellow, or black, thereby creating a full color image on the sheet.

Each of the image-formation units has the image-formation element thereof movably contained in the case, and the image-formation element includes the photosensitive body, an image-development unit, etc. The image-formation elements of the plurality of image formation units are stacked one over another where a connection between two elements situated one over the other is provided by the alignment/mount parts. This configuration allows a free choice to be made with regard to the number of image-formation elements, and has an advantage in that an increase in the number of image-formation elements does not result in an increase in an area occupied by the device.

Since a respective toner image of each image-formation unit needs to be transferred from a respective photosensitive body to a sheet, the case of the image-formation unit inevitably has an opening at a position of the photosensitive body for the purpose of transferring the image. This opening of the case allows toner, serving as a development agent, to spread from inside of the case to outside of the case, resulting in toner being accumulated inside the device as dirt. Further, replacement of an image-formation unit or refilling of toner is likely to result in spreading of toner, creating dirt in a periphery of the device. Because of these problems, excessive maintenance is required.

In consideration of these shortcomings, accordingly, there is a need for an image-formation device which can avoid making dirt inside the device and in a periphery thereof, thereby insuring formation of a high-quality image.

SUMMARY OF THE INVENTION

Accordingly, it is a general object of the present invention to provide an image-formation device which can satisfy the need described above.

It is another and more specific object to provide an image-formation device which can avoid making dirt inside the device and in a periphery thereof, thereby insuring formation of a high-quality image.

In order to achieve the above object, an image-formation device of the present invention includes a base-body unit having a control device and a detachable sheet-supply tray, four image-formation units for generating images in a respective color, i.e., cyan, magenta, yellow, or black, and a, sheet-conveyer/transfer unit which is vertically situated perpendicular to a horizontal extension of the base-body unit. Each of the image-formation units includes an image-formation element, a support member attached to the image-formation element, and a case which contains the support member along with the image formation element movably therein. The support member has alignment/mount parts situated at the top and the bottom thereof, which are provided with a recess and a guide bar, respectively.

The image-formation element includes a photosensitive body, an electrical-charge roller, an optical drawing unit, a development unit, a cleaning unit, and a discharging unit. The development unit develops an electrostatic latent image formed on the photosensitive body so as to make it visible by using liquid development agent, which is obtained by mixing toner particles with a solvent having an insulating property. Density of the toner particles in the solution is sufficiently high such that the liquid development agent sustains sufficient viscosity for the purpose of developing the electrostatic latent image.

The case has openings at positions where the alignment/mount parts of the support member are located. The base-body unit has a plurality of alignment/mount parts on an upper surface thereof, and these alignment/mount parts engage with the guide bars of the alignment/mount parts of an image-formation unit. Based on engagement between the alignment/mount parts of the base-body unit and the alignment/mount parts of the image-formation unit as well as engagement of the alignment/mount parts between the image-formation units, all the image-formation units are securely stacked one over another on the base-body unit.

The sheet-conveyer/transfer unit provided perpendicular to the horizontal extension of the base-body unit includes a conveyer belt extending in a vertical direction, a sheet-supply unit provided at the bottom of the conveyer belt, a fixation unit situated at the top of the conveyer belt, and transfer rollers provided at such positions as to oppose the respective photosensitive bodies of the image-formation units across the conveyer belt.

In the image-formation device as described above, the image-formation units create a respective development-agent image in a respective color, i.e., cyan, magenta, yellow, or black, as the development unit applies the liquid development agent to an electrostatic latent image formed on the photosensitive body. At the same time, the sheet-supply unit of the sheet-conveyer/transfer unit supplies a sheet to the conveyer belt, which conveys upwards the sheet attached thereto. As the sheet passes by the image-formation units, the photosensitive bodies of the image-formation units present the respective development-agent images in cyan, magenta, yellow and black, which are transferred onto the sheet by the transfer rollers at predetermined timings. This creates a full-color image on the sheet. The image on the sheet is fixed by the fixation unit before the sheet is ejected.

In this manner, the liquid development agent is used for developing an electrostatic latent image formed on the photosensitive body into a visible image, and, then, this image on the photosensitive body based on the liquid development agent is transferred onto a sheet. Use of the liquid development agent can prevent spreading of toner particles from the image-formation units, thereby avoiding making dirt inside the image-formation device as well as inside the image-formation units. Since replacement of the image-formation units or refilling of the development agent can be conducted without making dirt inside or in a periphery of the image-formation device, maintenance of the device is easily conducted.

Alternatively, an intermediary-transfer body is provided in each image-formation unit, and receives a development-agent image transferred from the photosensitive body. The development-agent image on the intermediary-transfer body is then transferred onto a sheet, and, thereafter, the remaining development agent on the intermediary-transfer body is collected by a transfer-body cleaning unit. No recycling use of the collected development agent is made. In this manner, a development agent of a given image-formation unit is not mixed with other development agents of different colors even when the development agent remaining on the photosensitive body is collected. This configuration prevents mixture of colors, thereby achieving a reliable formation of high-quality images.

Alternatively, an intermediary-transfer belt is provided to extend in a vertical direction in the sheet-conveyer/transfer unit. Development-agent images of respective colors, cyan, magenta, yellow, and black, formed on the photosensitive bodies of the image-formation units are first transferred to the intermediary-transfer belt to create a full-color development-agent image, and, then, the full-color development-agent image on the intermediary-transfer belt is further transferred onto a sheet at the bottom of the intermediary-transfer belt. The image on the sheet is fixed, and is ejected thereafter. This configuration can shorten a travel distance of the sheet, thereby reducing the number of instances where troubles such as jamming of sheets are created. Also, a corrective measure is easily taken when such troubles are generated.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
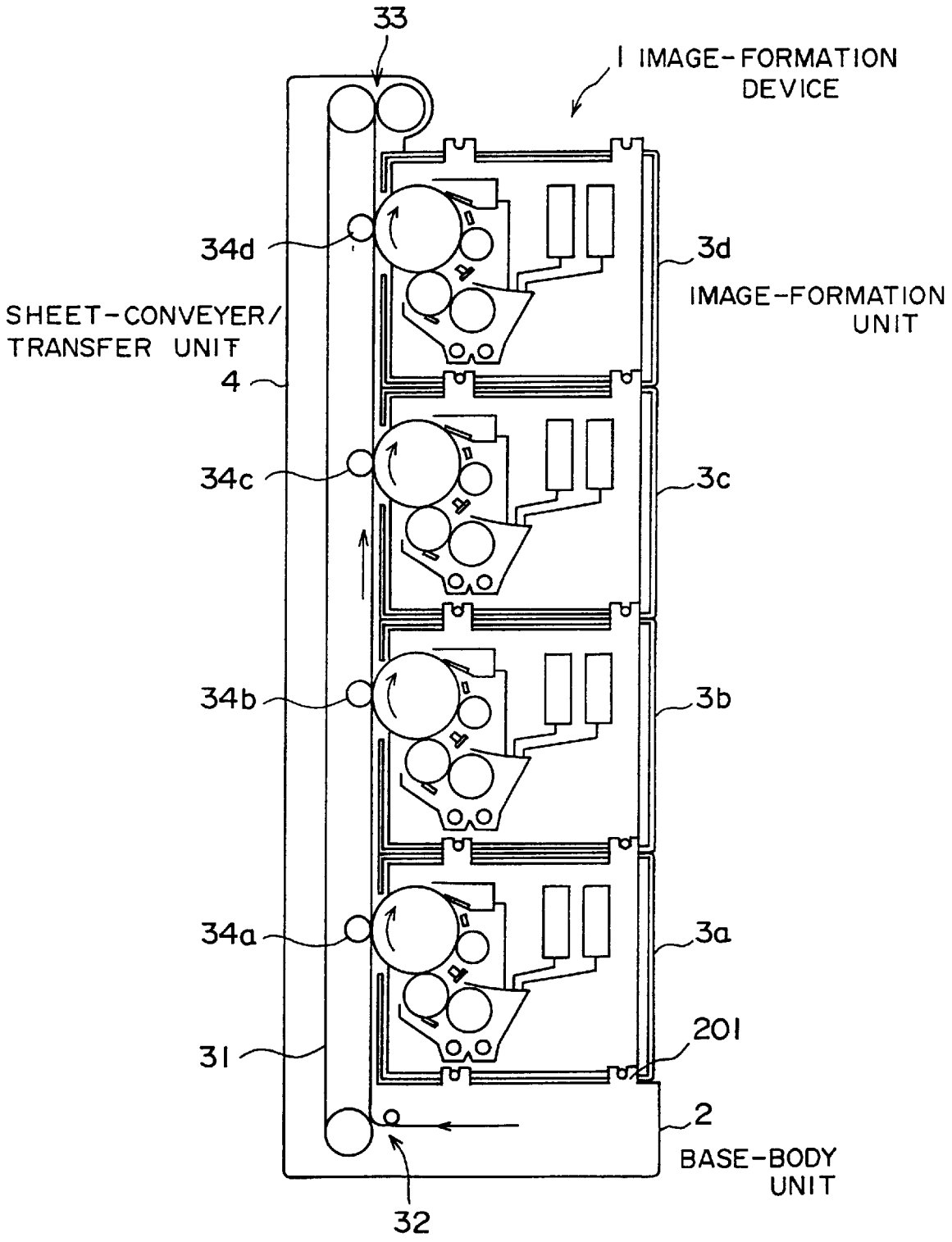
FIG. 1 is an illustrative drawing showing an embodiment of the present invention.

FIG. 1 is an illustrative drawing showing an embodiment of the present invention.

As shown in the figure, an image-formation device 1 includes a base-body unit 2, four image-formation units 3*a* through 3*d*, and a sheet-conveyer/transfer unit 4. The base-body unit 2 includes a control device and a detachable sheet-supply cassette (not shown). Each of the image-formation units 3*a* through 3*d* generates an image in a respective color, i.e., cyan, magenta, yellow, or black. The sheet-conveyer/transfer unit 4 is vertically positioned perpendicular to a horizontal extension of the base-body unit 2.

Figure 2:
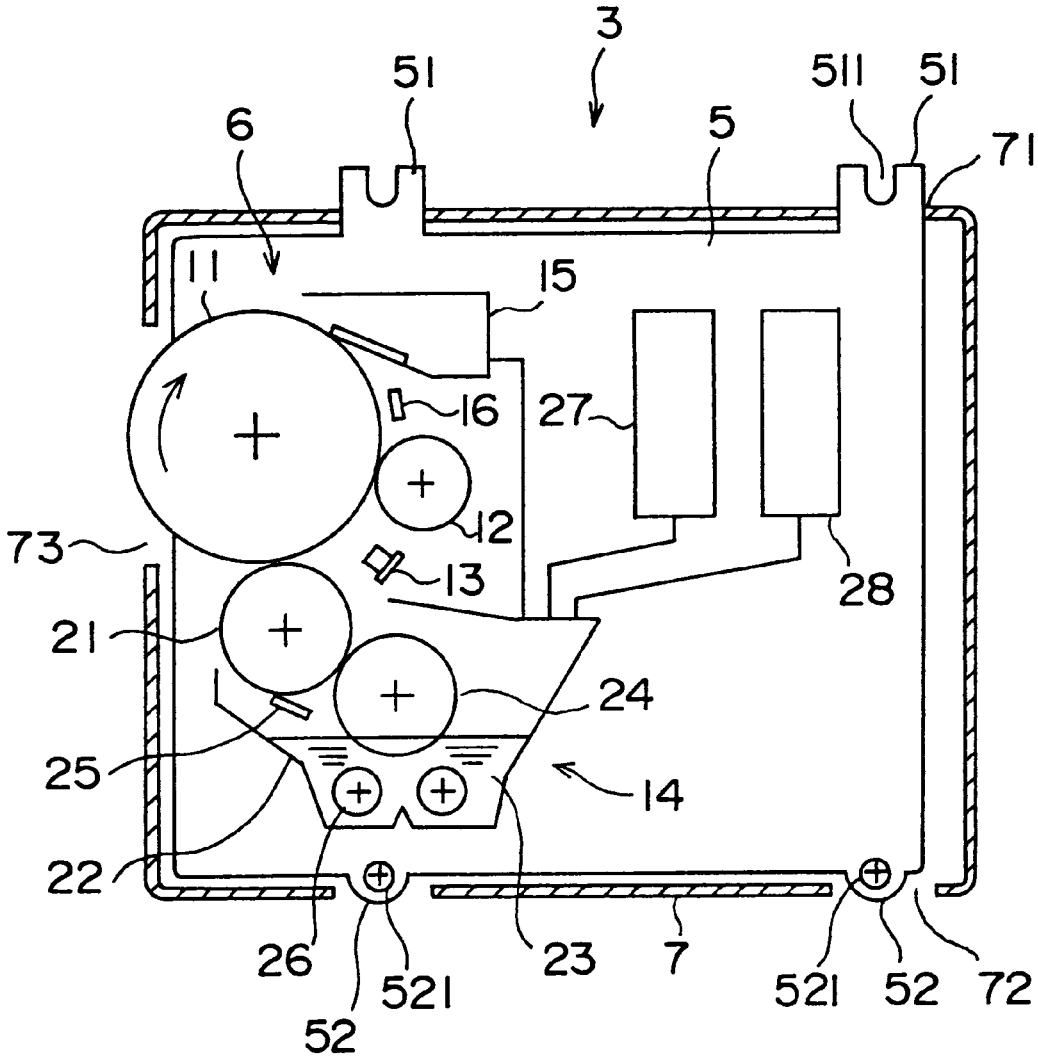
FIG. 2 is an illustrative drawing showing a detailed configuration of an image-formation unit.

FIG. 2 is an illustrative drawing showing a detailed configuration of an image-formation unit 3, which is a representative one of the image-formation units 3*a* through 3*d*.

As shown in FIG. 2, the image-formation unit 3 includes a support member 5, an image-formation element 6 fixedly attached to the support member 5, and a case 7 which contains the support member 5 with the image-formation element 6 attached thereto.

The support member 5 is movable inside the case 7. The support member 5 has alignment/mount parts 51 and 52, each of which is provided with a recess 511 and a guide bar 521, respectively. The recess 511 and the guide bar 521 engage between two image-formation units situated one over the other. The image-formation element 6 includes a photosensitive body 11, an electrical-charge roller 12, an optical drawing unit 13, a development unit 14, a cleaning unit 15, and a discharging unit 16. A surface of the photosensitive body 11 is electrically charged by the electrical-charge roller 12 in a homogeneous manner, and is exposed to light emitted from the optical drawing unit 13, thereby creating an electrostatic latent image thereon. The electrostatic latent image is then made visible by the development unit 14 so as to generate a development-agent image. The development-agent image on the photosensitive body 11 is transferred onto a sheet by the sheet-conveyer/transfer unit 4.

The cleaning unit 15 removes development agent remaining on the surface of the photosensitive body 11 after the transfer of the development-agent image onto the sheet. The development agent removed by the cleaning unit 15 is then collected by the development unit 14. Further, the electrical charge of the surface of the photosensitive body 11 is removed by the discharging unit 16, thereby preparing for a next image-formation process.

The development unit 14 includes a development roller 21, a liquid-development-agent container 22, an application roller 24 for applying liquid development agent 23 to the development roller 21 when the liquid development agent 23 is contained in the liquid-development-agent container 22, a development-agent collecting blade 25, a development-agent stirring member 26, a development-agent-supply unit 27, and a solvent-supply unit 28.

The development roller 21 is subjected to a bias voltage which is applied thereto as a development bias by a bias applying means (not shown), and rotates at such a speed as to achieve the same surface speed as that of the photosensitive body 11. The liquid development agent 23 is obtained by mixing particles of toner with a development-agent solvent such as dimethyl-polysiloxane oil, which is an insulator liquid. Since particles of toner are contained at a high density in the solution, the liquid development agent 23 has a high viscosity. When toner particles contained in the solution account for a few % to 20% in terms of a weight ratio, the viscosity of the liquid development agent 23 can become as high as 10 to 10000 mPa·s, thereby presenting a state ranging from a very viscous state to a substantially solid state.

The liquid development agent 23 in the liquid-development-agent container 22 is stirred by the development-agent stirring member 26 so as to keep a certain viscosity at a predetermined solution density. The liquid development agent 23 having a high viscosity is applied to the development roller 21 by the application roller 24 such that a layer of the development agent having a thickness between a few $\mu$m to about 20 $\mu$m is created on the surface of the development roller 21. The layer of the development agent on the development roller 21 is used for developing the electrostatic latent image on the photosensitive body 11, thereby making the image visible. The development roller 21 and the photosensitive body 11 move at the same speed. The liquid development agent 23 remaining on the surface of the development roller 21 following the development process is removed by the development-agent collecting blade 25, and is collected in the liquid-development-agent container 22.

The development process is repeated many times, so that the liquid development agent 23 in the liquid-development-agent container 22 may change a viscosity thereof during a series of development processes. When this happens or when the amount of the liquid development agent 23 in the liquid-development-agent container 22 falls below a certain required amount, the development-agent-supply, unit 27 and the solvent-supply unit 28 supply the development agent and the solvent to the liquid-development-agent container 22, such that the liquid development agent 23 in the liquid-development-agent container 22 is adjusted to have an appropriate viscosity.

The case 7 has openings 71 and 72 at positions where the alignment/mount parts 51 and 52 of the support member 5 are located, respectively. Further, the case 7 has an opening 73 where the photosensitive body 11 of the image-formation element 6 is provided.

The base-body unit 2 has a plurality of alignment/mount parts 201 on an upper surface thereof, and the alignment/mount parts 201 receive the guide bar 521 of the alignment/mount parts 51 and 52 fitting therein. Based on engagement between the alignment/mount parts 201 of the base-body unit 2 and the alignment/mount parts 52 of the image-formation unit 3*a* as well as engagement between the alignment/mount parts 51 and 52, the image-formation units 3*a* through 3*d* are securely stacked one over another on the base-body unit 2. The sheet-conveyer/transfer unit 4 provided perpendicular to the horizontal extension of the base-body unit 2 includes a conveyer belt 31 extending in a vertical direction, a sheet-supply unit 32 provided at the bottom of the conveyer belt 31, a fixation unit 33 situated at the top of the conveyer belt 31, and transfer rollers 34*a* through 34*d* provided at such positions as to oppose the respective photosensitive bodies 11 of the image-formation units 3*a* through 3*d* across the conveyer belt 31.

In the image-formation device as described above, the image-formation units 3*a* through 3*d* create a respective development-agent image in a respective color, i.e., cyan, magenta, yellow, or black, as the development unit 14 applies the liquid development agent 23 to an electrostatic latent image formed on the photosensitive body 11. At the same time, the sheet-supply unit 32 of the sheet-conveyer/transfer unit 4 supplies a sheet to the conveyer belt 31, which conveys upwards the sheet attached thereto. As the sheet passes by the image-formation units 3*a* through 3*d*, the photosensitive bodies 11 of the image-formation units 3*a* through 3*d* present the respective development-agent images in cyan, magenta, yellow and black, which are transferred onto the sheet by the transfer rollers 34*a* through 34*d* at predetermined timings. This creates a full-color image on the sheet. The image on the sheet is fixed by the fixation unit 33 before the sheet is ejected.

In this manner, the liquid development agent 23 is used for developing an electrostatic latent image formed on the photosensitive body 11 into a visible image, and, then, this image on the photosensitive body 11 based on the liquid development agent 23 is transferred onto a sheet. Use of the liquid development agent 23 can prevent spreading of toner particles from the image-formation units 3*a* through 3*d*, thereby avoiding making dirt inside the image-formation device 1 as well as inside the image-formation units 3*a* through 3*d*. Since replacement of the image-formation units 3*a* through 3*d* or refilling of the development agent can be conducted without making dirt inside or in a periphery of the image-formation device 1, maintenance of the device is easily conducted.

The above embodiment has been described with reference to an example in which a development-agent image formed on the photosensitive body 11 of the image-formation units 3*a* through 3*d* is directly transferred onto a sheet.

Figure 3:
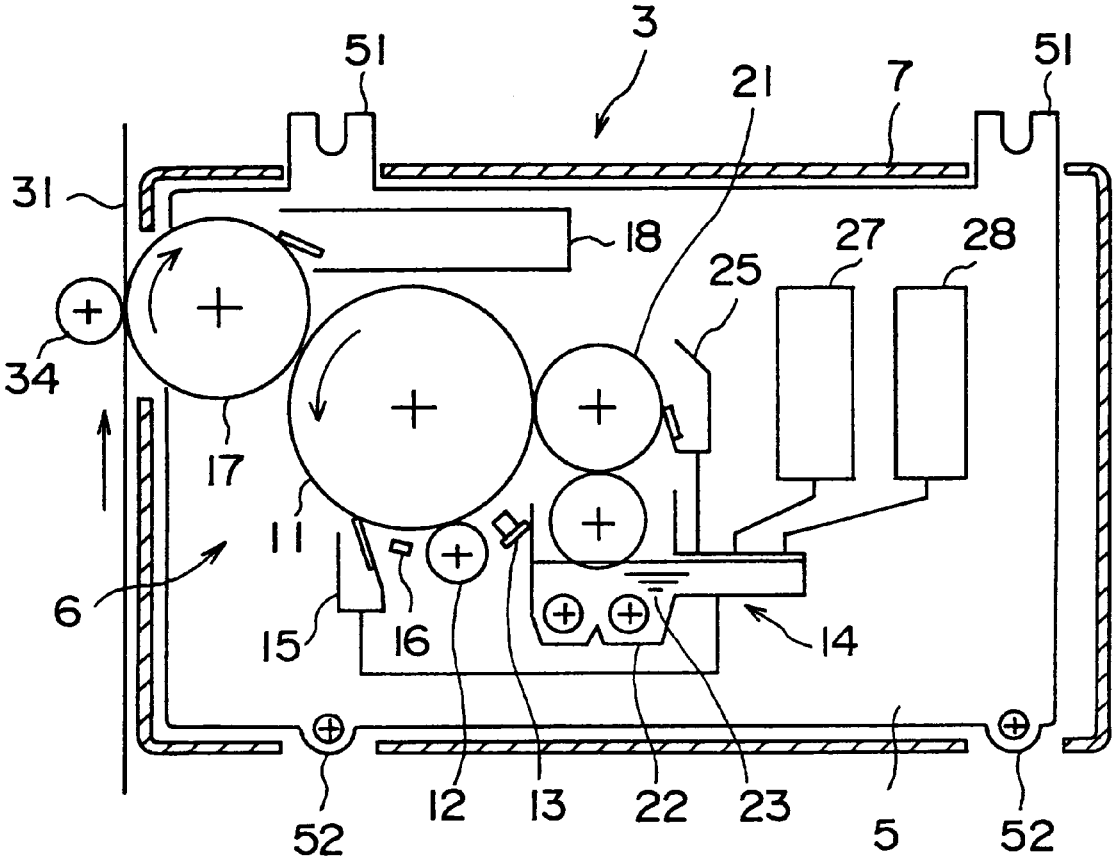
FIG. 3 is an illustrative drawing showing another embodiment of the present invention.

FIG. 3 is an illustrative drawing showing another embodiment of the present invention.

As shown in FIG. 3, an intermediary-transfer body 17 and a transfer-body cleaning unit 18 may be additionally provided in each of the image-formation units 3*a* through 3*d*. The intermediary-transfer body 17 is in contact with the photosensitive body 11, and rotates in an opposite direction against the rotation of the photosensitive body 11. In this configuration, a development-agent image formed on the photosensitive body 11 is first transferred onto the intermediary-transfer body 17, and, then, the image on the intermediary-transfer body 17 is further transferred onto a sheet. After the transfer of the development-agent image onto the sheet, the development agent remaining on the intermediary-transfer body 17 is collected by the transfer-body cleaning unit 18, and is kept in storage without recycling use thereof. Since the development agent remaining on the intermediary-transfer body 17 and collected by the transfer-body cleaning unit 18 is not used for a recycling purpose, the development agent of a particular color contained in the development unit 14 is not mixed with the development agent of another color even when the development agent remaining on the photosensitive body 11 is collected by the cleaning unit 15 and deposited into the development unit 14. This prevents mixture of different colors, thereby insuring a reliable formation of high-quality images.

The embodiment described above has been described with reference to a case in which a respective development-agent image formed on each photosensitive body 11 of the image-formation units 3*a* through 3*d* is transferred onto a sheet either directly or indirectly via the intermediary-transfer body 17. Alternatively, development-agent images having a respective color, which are formed on the photosensitive bodies 11 of the image-formation units 3*a* through 3*d*, may be combined to create a development-agent image in full color, and, then, the full-color development-agent image may be transferred onto a sheet.

Figure 4:
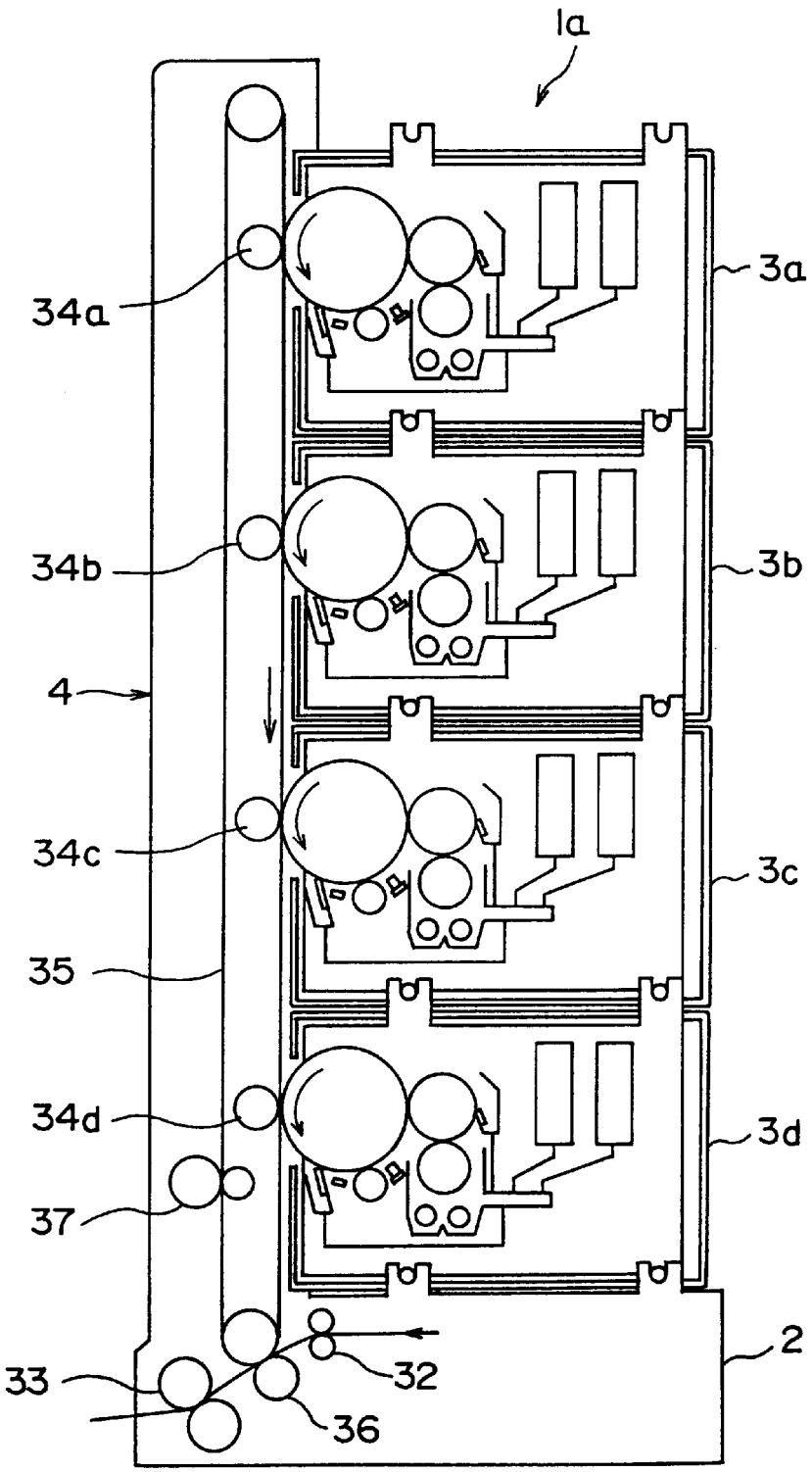
FIG. 4 is an illustrative drawing showing a configuration of yet another embodiment in which a full-color development-agent image is created based on development-agent images of respective colors formed on photosensitive bodies of image-formation units.

FIG. 4 is an illustrative drawing showing a configuration of yet another embodiment in which a full-color development-agent image is created based on development-agent images of respective colors formed on the photosensitive bodies 11 of the image-formation units 3*a* through 3*d*.

An image-formation device 1*a* of FIG. 4 has the sheet-conveyer/transfer unit 4 which includes an intermediary-transfer belt 35 extending in a vertical direction, a transfer unit 36 in contact with a bottom portion of the intermediary-transfer belt 35, and a belt cleaning unit 37 in contact with the intermediary-transfer belt 35 and provided downstream of the transfer unit 36 in terms of the driving direction of the intermediary-transfer belt 35.

Figure 5:
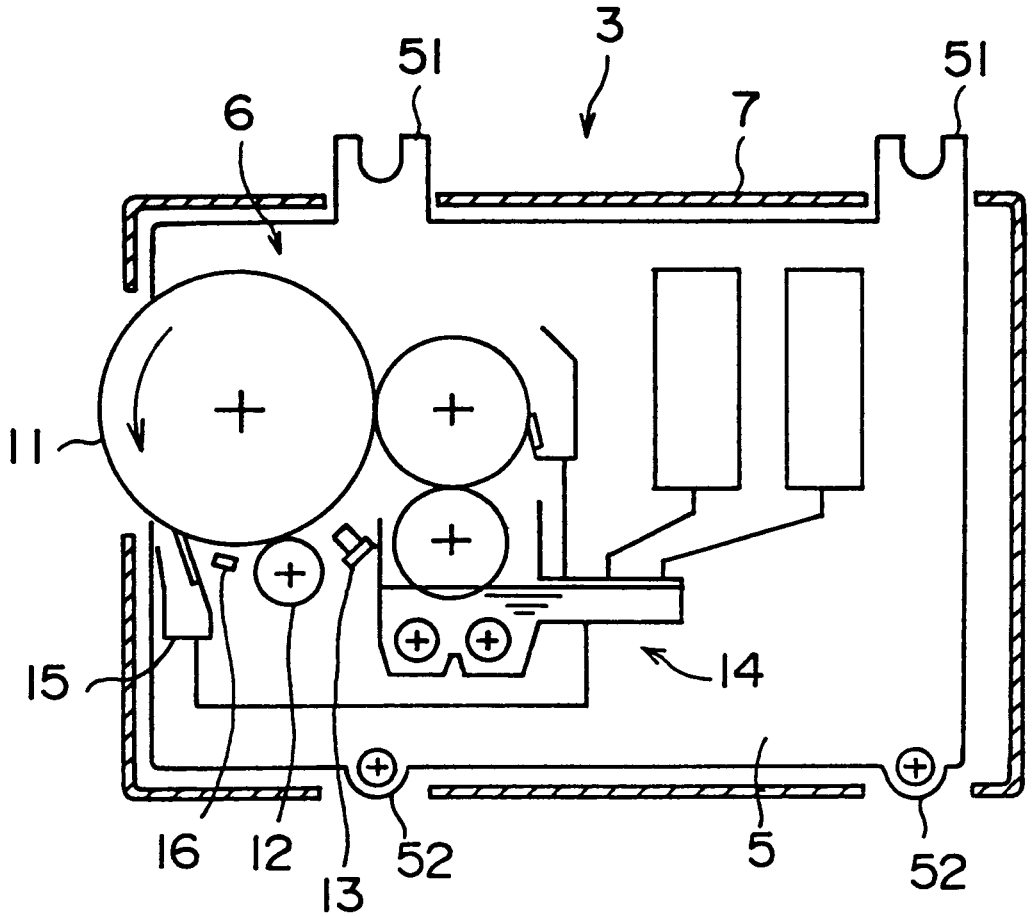
FIG. 5 is an illustrative drawing showing a configuration of an image-formation unit used in the configuration of FIG. 4.

FIG. 5 is an illustrative drawing showing a configuration of an image-formation unit 3 as a representative one of the image-formation units 3*a* through 3*d* used in the configuration of FIG. 4. As shown in the figure, the image-formation unit 3 has the photosensitive body 11 which rotates in a counterclockwise direction in this particular view of the figure.

Development-agent images in cyan, magenta, yellow, and black, which are formed on the photosensitive bodies 11 of the image-formation units 3*a* through 3*d* by using the liquid development agents 23, are transferred to the intermediary-transfer belt 35 by the transfer rollers 34*a* through 34*d*. This creates a full-color development agent-image on the surface of the intermediary-transfer belt 35. The full-color development-agent image is then transferred onto a sheet by the transfer unit 36, and is fixed by the fixation unit 33 before the sheet is ejected. The development agents remaining on the intermediary-transfer belt 35 are removed by the belt cleaning unit 37. This configuration makes a travel distance of the sheet shorter, thereby reducing a number of instances in which troubles such as jamming of the sheets take place. Also, a corrective measure is easily taken when such troubles are generated.

As described above, since the image-formation units are stacked one over another on the base-body unit, a floor space occupied by the device is about the same size as the horizontal space of an image-formation unit. The floor space occupied by the device is thus relatively small, providing an extra space in a periphery of the device.

Further, each image-formation unit develops an electrostatic latent image into a visible image where the electrostatic latent image is formed on the photosensitive body via the liquid development agent. Use of the liquid development agent can prevent spreading of toner particles from the image-formation unit, thereby avoiding making dirt inside the image-formation device as well as inside the image-formation unit. Since replacement of the image-formation unit or refilling of the development agent can be conducted without making dirt inside or in a periphery of the image-formation device, maintenance of the device is easily conducted.

Also, the intermediary-transfer body is provided in each image-formation unit, and receives a development-agent image transferred from the photosensitive body. The development-agent image on the intermediary-transfer body is then transferred onto a sheet, and, thereafter, the remaining development agent on the intermediary-transfer body is collected by the transfer-body cleaning unit. No recycling use of the collected development agent is made. In this manner, a development agent of a given image-formation unit is not mixed with other development agents of different colors even when the development agent remaining on the photosensitive body is collected. This configuration prevents mixture of colors, thereby achieving a reliable formation of high-quality images.

Further, the intermediary-transfer belt is provided to extend in a vertical direction in the sheet-conveyer/transfer unit. Development-agent images of respective colors, cyan, magenta, yellow, and black, formed on the photosensitive bodies of the image-formation units are first transferred to the intermediary-transfer belt to create a full-color development-agent image, and, then, the full-color development-agent image on the intermediary-transfer belt is further transferred onto a sheet at the bottom of the intermediary-transfer belt. The image on the sheet is fixed, and is ejected thereafter. This configuration can shorten a travel distance of the sheet, thereby reducing the number of instances where troubles such as jamming of sheets are created. Also, a corrective measure is easily taken when such troubles are generated. Some of the features of the present invention are equally applicable to a dry-process development scheme.

Further, the present invention is not limited to these embodiments, but various variations and modifications may be made without departing from the scope of the present invention.

What is claimed is:

1. A device comprising:

a plurality of image-formation units stacked one over another;

a photosensitive body, provided in each of said image-formation units, which has an electrostatic latent image formed thereon;

a development unit, provided in each of said image-formation units, which develops said electrostatic latent image with a liquid development agent to create a development-agent image on said photosensitive body;

an intermediary-transfer body, provided in each of said image-formation units, which receives said development-agent image transferred from said photosensitive body;

a sheet-conveyer/transfer unit which transfers each of the development-agent images formed on respective intermediary-transfer bodies of the image-formation units onto a sheet conveyed by the sheet-conveyor/transfer unit.

2. The device as claimed in claim 1, further comprising:

cleaning unit, provided in each of said image-formation units, which collects a development agent remaining on said photosensitive body after transfer of said development-agent image from said photosensitive body to said intermediary-transfer body, thereby availing said development agent for recycling use in said development unit; and a transfer-body cleaning unit, provided in each of said image-formation units, which collects a development agent remaining on said intermediary-transfer body after transfer of said development-agent image from said intermediary-transfer body onto said sheet, the development agent collected thereby being not availed for said recycling use.

3. The device as claimed in claim 1, wherein the developing-agent images are formed on selected portions of respective intermediary-transfer bodies of the image formation units, resulting development-agent images on said respective intermediary-transfer bodies formed on said selected portions thereof being transferred onto said sheet.

4. The device as claimed in claim 3, wherein said intermediary-transfer body comprises a belt forming a loop.

5. The device as claimed in claim 1, wherein said liquid development agent has a predetermined viscosity that is sufficient to create said development-agent image.

6. The device as claimed in claim 1, wherein each of said image-formation units comprises:

a case; and a support member which securely supports said photosensitive body and said development unit attached thereto, and has alignment portions effecting an alignment between the image-formation units situated one over another, wherein said case contains said support member such that said support member is movable within said case.

7. The device as claimed in claim 1, further comprising:

a development-agent-supply unit, provided in each of said image-formation units, which supplies a development agent comprising particles; and a solvent-supply unit, provided in each of said image-formation units, which supplies solvent to be mixed with said development agent comprising particles.

8. A method of forming a full-color image, comprising:

creating electrostatic latent images on respective photosensitive bodies;

developing said electrostatic latent images by using liquid development agents having respective colors so as to create development-agent images having said respective colors on said respective photosensitive bodies;

transferring said development-agent images to respective intermediary-transfer bodies transferring said development agent images on said respective intermediary-transfer bodies onto a sheet so as to create a full-color image on said sheet; and fixing said full-color image on said sheet.

9. The method as claimed in claim 8, further comprising a step of mixing a development agent comprising particles with a solvent so as to create a respective one of said liquid development agents.

* * * * *